US007017525B2

(12) United States Patent
Leach

(10) Patent No.: US 7,017,525 B2
(45) Date of Patent: Mar. 28, 2006

(54) MULTIPURPOSE HARNESS ASSEMBLY FOR USE IN ASSISTING A MUSCULAR-INCAPACITATED PERSON

(76) Inventor: Janet Marilyn Leach, 305 Longfellow St., NE., Fridley, MN (US) 55432

( * ) Notice: Subject to any disclaimer, the term of this patent is extended or adjusted under 35 U.S.C. 154(b) by 310 days.

(21) Appl. No.: 10/300,077

(22) Filed: Nov. 20, 2002

(65) Prior Publication Data

US 2004/0225243 A1 Nov. 11, 2004

(51) Int. Cl.
*A61G 7/10* (2006.01)
*A62B 35/00* (2006.01)

(52) U.S. Cl. ..... 119/770; 5/81.1 T; 224/160

(58) Field of Classification Search ..... 119/770, 119/857; 297/484; 5/81.1 R, 81.1 T; 224/160; 128/875

See application file for complete search history.

(56) References Cited

U.S. PATENT DOCUMENTS

| | | | | | |
|---|---|---|---|---|---|
| 1,518,830 | A | | 12/1924 | Woods | |
| 1,749,999 | A | | 3/1930 | Crocker | |
| 2,212,746 | A | * | 8/1940 | Nunn | 119/770 |
| 2,407,714 | A | * | 9/1946 | Maloney | 224/160 |
| 2,535,683 | A | | 12/1950 | Kimball | |
| 2,643,803 | A | * | 6/1953 | Bates | 224/254 |
| 2,677,488 | A | | 5/1954 | Prusan | |
| 3,321,247 | A | * | 5/1967 | Dillender | 297/465 |
| 4,226,474 | A | * | 10/1980 | Rupert et al. | 297/484 |
| 4,273,215 | A | * | 6/1981 | Leggett | 182/3 |
| 4,445,866 | A | * | 5/1984 | Cillieres | 434/253 |
| 4,450,991 | A | * | 5/1984 | Gougeon | 224/159 |
| 4,560,097 | A | | 12/1985 | Reynolds et al. | |
| 4,667,624 | A | | 5/1987 | Smith | |
| 4,903,355 | A | | 2/1990 | Hickerson | |
| 5,076,598 | A | * | 12/1991 | Nauman | 280/202 |
| 5,101,768 | A | | 4/1992 | Cates | |
| 5,183,007 | A | * | 2/1993 | Vincent | 119/770 |
| 5,397,171 | A | | 3/1995 | Leach | |
| 5,896,859 | A | * | 4/1999 | Carroll | 128/845 |
| 6,009,839 | A | * | 1/2000 | Kohn | 119/770 |

(Continued)

*Primary Examiner*—Teri Pham Luu
*Assistant Examiner*—Susan C. Alimenti
(74) *Attorney, Agent, or Firm*—Michael A. Mochinski

(57) ABSTRACT

A multipurpose harness assembly for lifting and supporting a person characteristically known to have little or no control over muscular function insofar to support oneself for purposes of standing erect or walking, the harness assembly comprising a pair of wearable harness, one of which is worn by an assisting person and a second harness being worn by a muscular-incapacitated person. Each harness comprises left- and right-handed shoulder straps tighteningly secured to the wearer by a waist belt and an upper torso strap, both of which are slidably fitted through a plurality of strap guides selectively mounted to each of the shoulder straps and tighteningly held in place by a waist buckle and an upper torso buckle, respectively, and at least one horizontal support member fixedly attached to the shoulder straps to maintain a parallel relationship to one another and minimize the occurrence of slippage from the wearer's shoulder. A pair of supporting tethers each having a first end fixedly attached to the shoulder strap of the harness worn by the assisting person and a second end releasably connected to the harness worn by the muscular-incapacitated person effectively serve as means to connect the two harnesses together for purposes of engaging in the activities of lifting the muscular-incapacitated person from an at-rest position and supporting and guiding the muscular-incapacitated person as he or she proceeds to walk, sit or stand erect in a stationary position.

4 Claims, 7 Drawing Sheets

U.S. PATENT DOCUMENTS 6,325,023 B1 12/2001 Elnatan
6,361,478 B1 * 3/2002 Giancaspro ..... 482/69
6,637,547 B1 * 10/2003 Wydner ..... 182/3
6,651,594 B1 * 11/2003 Bagwell ..... 119/770

* cited by examiner

MULTIPURPOSE HARNESS ASSEMBLY FOR USE IN ASSISTING A MUSCULAR-INCAPACITATED PERSON

FIELD OF THE INVENTION

The present invention relates in general to a multipurpose harness assembly made adaptable for wear by a health care worker or assistant for purposes of lifting and positioning a person in an upright standing orientation from a lying or sitting position and assisting the person while she or he proceeds to walk, sit or stand erect. More specifically, the present invention provides mobile means to efficiently lift and support a person having little or no control over limb movement insofar to support oneself in an erect, standing position, generally resulting from a long- or short-term disability.

BACKGROUND OF THE INVENTION

Many institutions such as hospitals, physical therapy centers, schools and the like house and accommodate a number of individuals having certain disabilities, some of which hinder the person's ability to walk, sit or stand erect. For instance, a muscular-related disorder caused by muscular dystrophy or a stroke may greatly hinder a person's ability to stand erect or walk, particularly while he or she is residing at an institution for treatment or being schooled in an educational setting. Given the person's muscular incapacities, a number of mechanical devices have been developed and used over the years to assist in positioning and moving the muscular-incapacitated person or patient for treatment. Some of these mechanical devices are particularly suited to lift the patient in a stationary, upright position for bedside treatment, and yet in other cases to lift and situate the patient in a mobile device, such as a wheelchair, for relocation within the institution, perhaps for administration of non-bedside treatments. Prior art devices of more advanced nature typically comprise a hoist of the type having an outwardly extending boom which centers above the patient and a crank selectively mounted to a vertical support which provides means to lift and lower the patient in a variety of positions for treatment or transport. The use of such device may involve the patient being fitted with a series of straps which are positionally networked over the patient's body, with one of the straps generally being equipped with a hook having capabilities to attach to an outer extending portion of the boom. After attachment of the straps and at the moment of lifting, the patient's body generally becomes configurably cradled until which time the patient is re-situated in a chair or bed. Other prior art means to lift and lower a muscular-incapacitated person are more simplistic in nature and would comprise simply of a health care worker or workers selectively positioning his or her arms about the disabled person's body, specifically near the upper torso, and lifting he or she with coordinated leg and arm movement. As one can imagine the execution of such technique may cause injury to both the disabled person and health care worker since it relies on most part on the strength and efficiency of the health care worker, and may become increasingly more difficult where the disabled person is unable to assist in any way to lift and guide oneself for purposes of either walking or standing erect. Other prior art devices, particularly those that tend to fall within the spectrum of a mechanical hoisting device and more primitive means of lifting with arms and legs, may comprise a harness of the type that can be fitted onto a disabled child or small adult and a health care assistant, such as the one described in U.S. Pat. No. 4,450,991 issued to Gougeon. This type of device, which completely suspends the person above the ground, generally weighing 100 pounds or less, alleviates the extent of muscular strength needed to lift and support the disabled person as a result of the straps being strategically fitted about the wearer insofar to distribute the weight more evenly thereabout. Although the relevant art comprises a broad range of person-assisting devices, most, however, are directed to a specific patient activity, generally to either lifting the patient from an at-rest position, suspending the patient above the ground for a short duration, or supporting the patient while he or she engages in the activity of walking, such as a grab-bar walker of the type commonly known in the art.

In accordance with the present invention, applicant has appreciably devised a multipurpose harness assembly which can be comfortably worn on both the disabled person and health care worker to assist in lifting the disabled person in an upright orientation, generally for the purpose of administrating treatment at a health care institution or preparing for transport therewithin or to a classroom in an educational setting. Furthermore, the present invention effectively serves as means to assist the health care worker or assistant in guiding and supporting the disabled person or patient as he or she proceeds to engage in the activity of walking, sitting or standing erect in a stationary position.

BRIEF SUMMARY OF THE INVENTION

In order to overcome the numerous drawbacks apparent in the prior art, a multipurpose harness assembly has been devised for use in a hospice or an educational setting to lift a person having little or no control over limb movement insofar to support oneself in an erect standing position for purposes of administrating treatment or transport.

It is thus an object of the present invention to provide a low cost, non-complicated multipurpose harness assembly which may be reliably used to guide and support a disabled person or patient while he or she engages in the activity of walking or standing in an erect, stationary position.

It is another object of the present invention to provide such a multipurpose harness assembly which affords versatility in terms of functioning in a variety of hospice or educational settings, including hospitals, nursing or retirement homes, therapeutic centers, schools, and other institutions characteristically known to care for and house individuals having muscular-related disorders.

It is another object of the present invention to provide such a multipurpose harness assembly which affords freedom of arm movement for both the health care assistant and muscular-incapacitated person for added control during the activity of walking or standing erect.

It is yet another object of the present invention to provide such a multipurpose harness assembly which is capable of being securely fastened to and comfortably worn by a health care assistant and muscular-incapacitated person continually for long durations and for a range of person-assisting activities, such as lifting, guiding, and supporting the patient.

It is another object of the present invention to provide such a multipurpose harness assembly which possesses the capacity to be decorative and fashionable as an article of clothing and sized to conform to a variety of body types and configurations.

It is yet another object of the present invention to provide such a multipurpose harness assembly which comprises means to completely suspend a person of nominal weight, generally a child or small adult of 100 pounds or less, for the purpose of administrating bedside treatment or preparing the person for transport within the institution for receipt of non-bedside treatments.

It is yet another object of the present invention to provide such a multipurpose harness assembly which incorporates detachable means to lift and support another person similarly fitted with a harness.

It is yet another object of the present invention to provide such a multipurpose harness assembly which accomplishes the foregoing and other objects and advantages and which is economical, durable, and fully effective in performing its intended functions.

In accordance with the present invention, a multipurpose harness assembly has been devised for use by a health care worker or assistant to lift and support a person having little or no control over limb movement insofar to support oneself for the purpose of engaging in the activity of walking or standing erect in stationary position, the multipurpose harness assembly comprising in combination a pair of wearable harnesses, one of which being worn by a health care assistant (referred hereinafter as a support harness) and a second harness being worn by a muscular-incapacitated person (referred hereinafter as a recipient harness), each harness comprising left- and right-handed shoulder straps configurably arranged in a parallel relationship and tightening secured to the wearer by a waist belt and an upper torso strap, both of which are slidably fitted through a plurality of strap guides selectively mounted to each of the shoulder straps and tightening held in place by a waist buckle and an upper torso buckle, respectively; and at least one horizontal support member fixedly attached to the shoulder straps to maintain a parallel relationship to one another and minimize the occurrence of slippage from the wearer's shoulder. A pair of supporting tethers each having a first end fixedly attached to the shoulder strap of the support harness and a second end suitably equipped with a fastener for engaging an equal number of support rings made part of the recipient harness effectively serve as means to connect the two harnesses together for purposes of engaging in activities of lifting the disabled person from an at-rest position and supporting and guiding the disabled person as he or she proceeds to walk, sit or stand erect.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiments illustrated and presented herein. The present invention has particular utility as a device for lifting and supporting a person having little or no control over limb movement insofar to support oneself for purposes of engaging in the activity of walking, sitting or standing erect in a stationary position.

Figure 1:
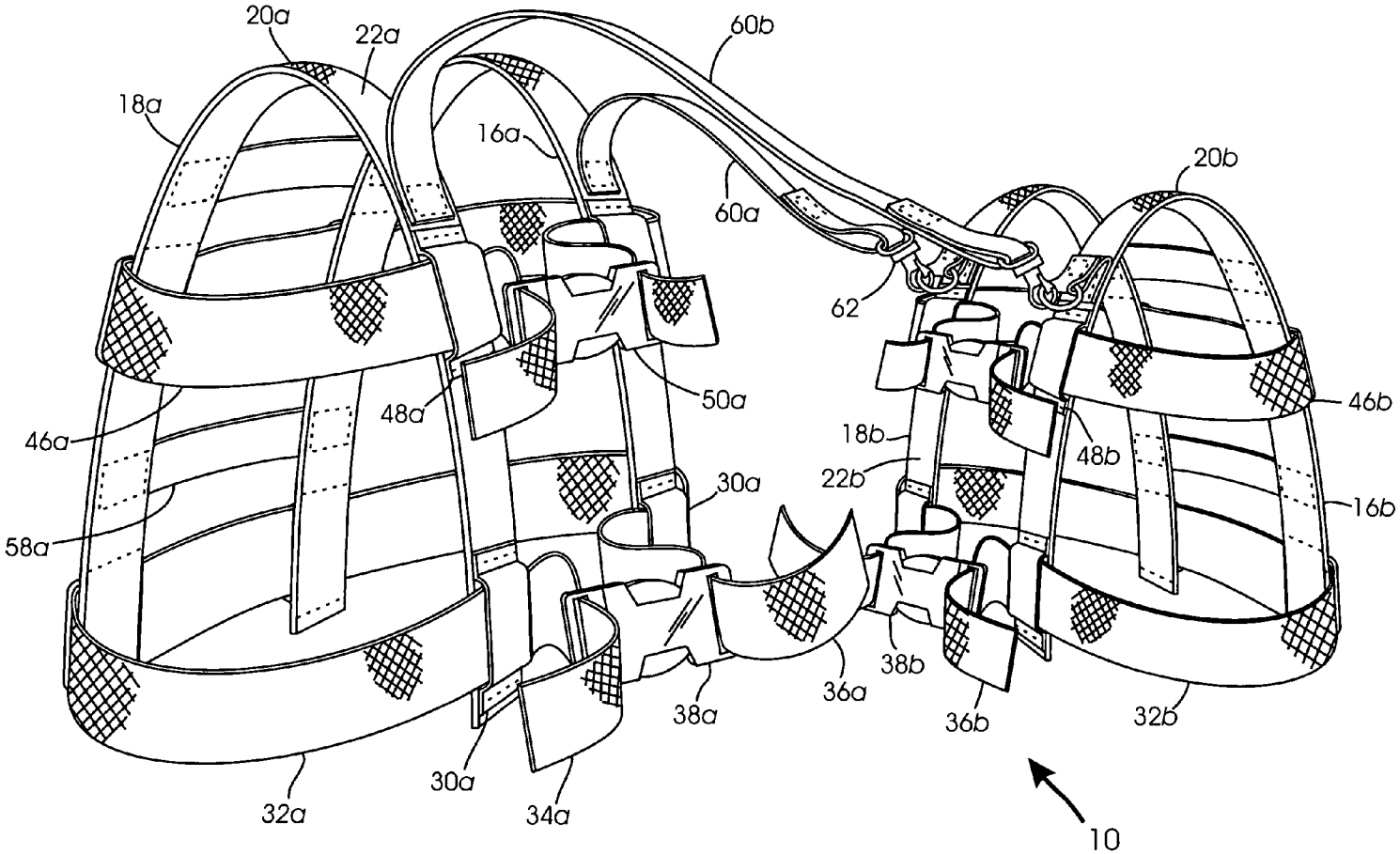
FIG. 1 is a perspective view of the preferred embodiment of the present invention illustrating a support harness releasably connected to a recipient harness using a pair of supporting tethers.

Referring now to FIG. 1, there is shown generally at 10 a multipurpose harness assembly comprising a pair of wearable harnesses 12, 14, one of which being worn by a health care worker or assisting person (referred hereinafter as a support harness 12) and a second harness being worn by a disabled person or an individual characteristically known to have little or no control over muscular function to enable leg movement or support of oneself for purposes of standing erect or walking (referred hereinafter as a recipient harness 14).

Figure 2:
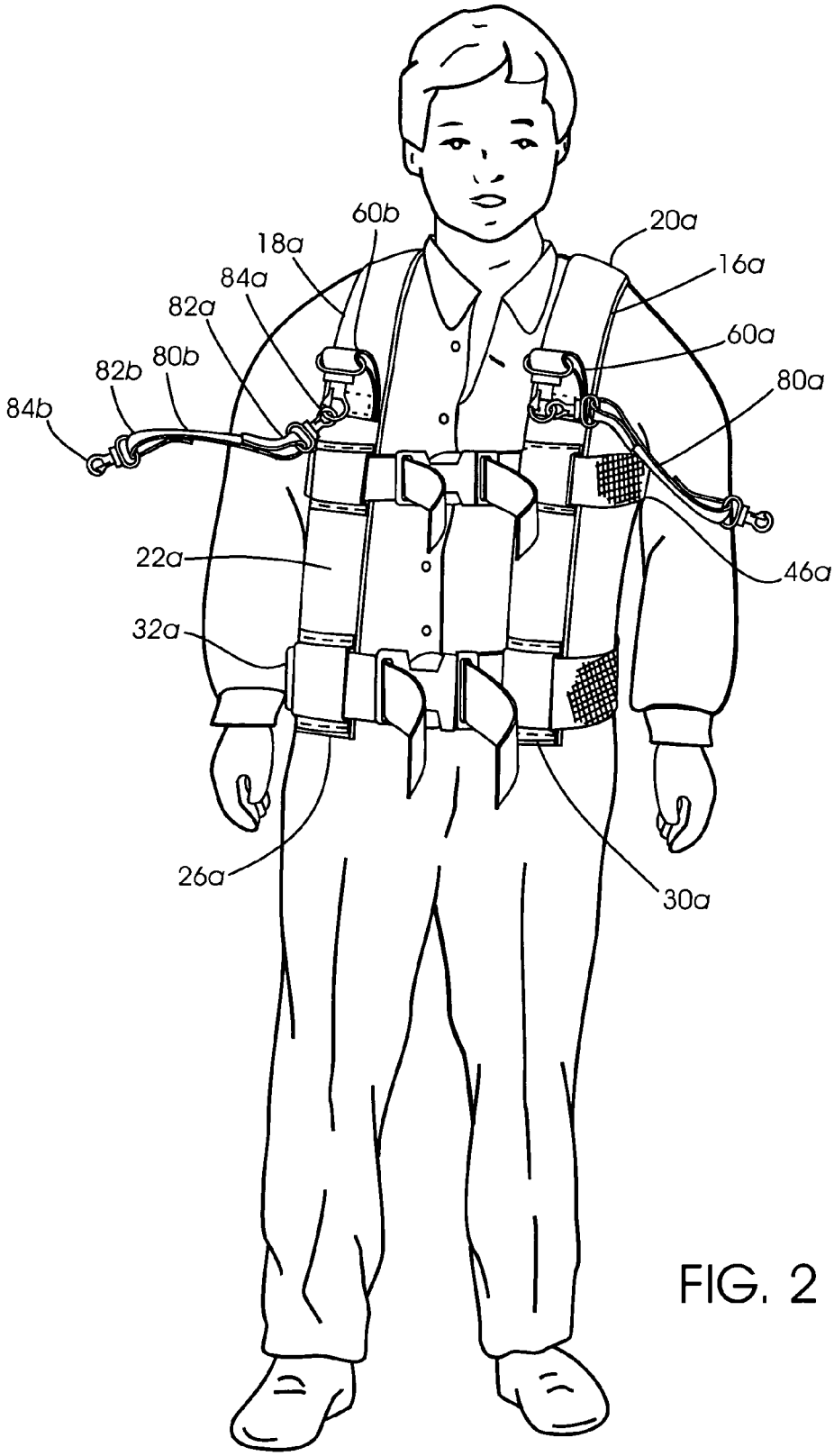
FIG. 2 is a front perspective view of the preferred embodiment of the present invention illustrating a health care assistant in a standing position and wearing a support harness having a pair of shortened supporting tethers attached thereto.
Figure 3:
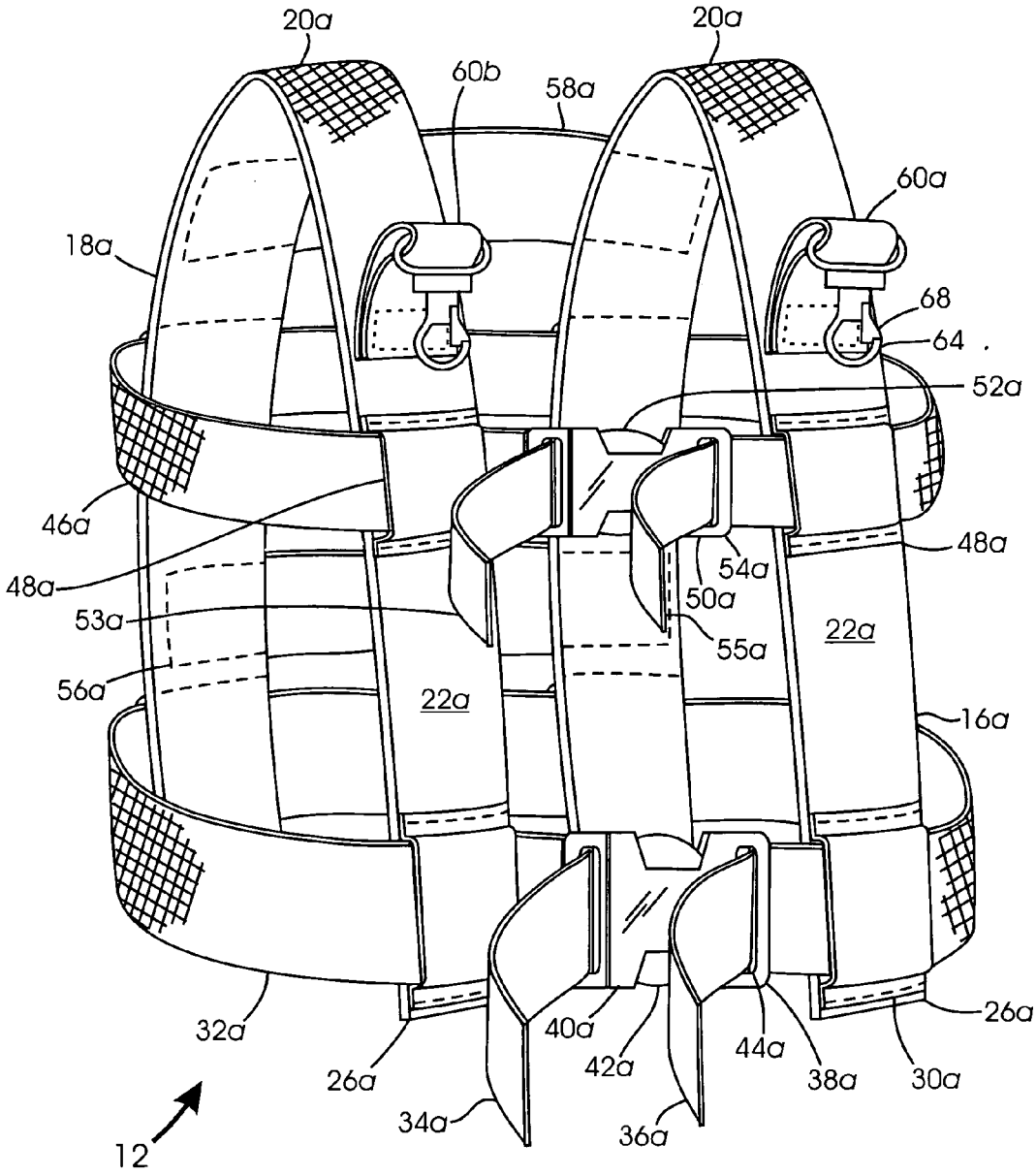
FIG. 3 is a front perspective view of the preferred embodiment of the present invention illustrating a support harness having a pair of shortened supporting tethers attached thereto.
Figure 4:
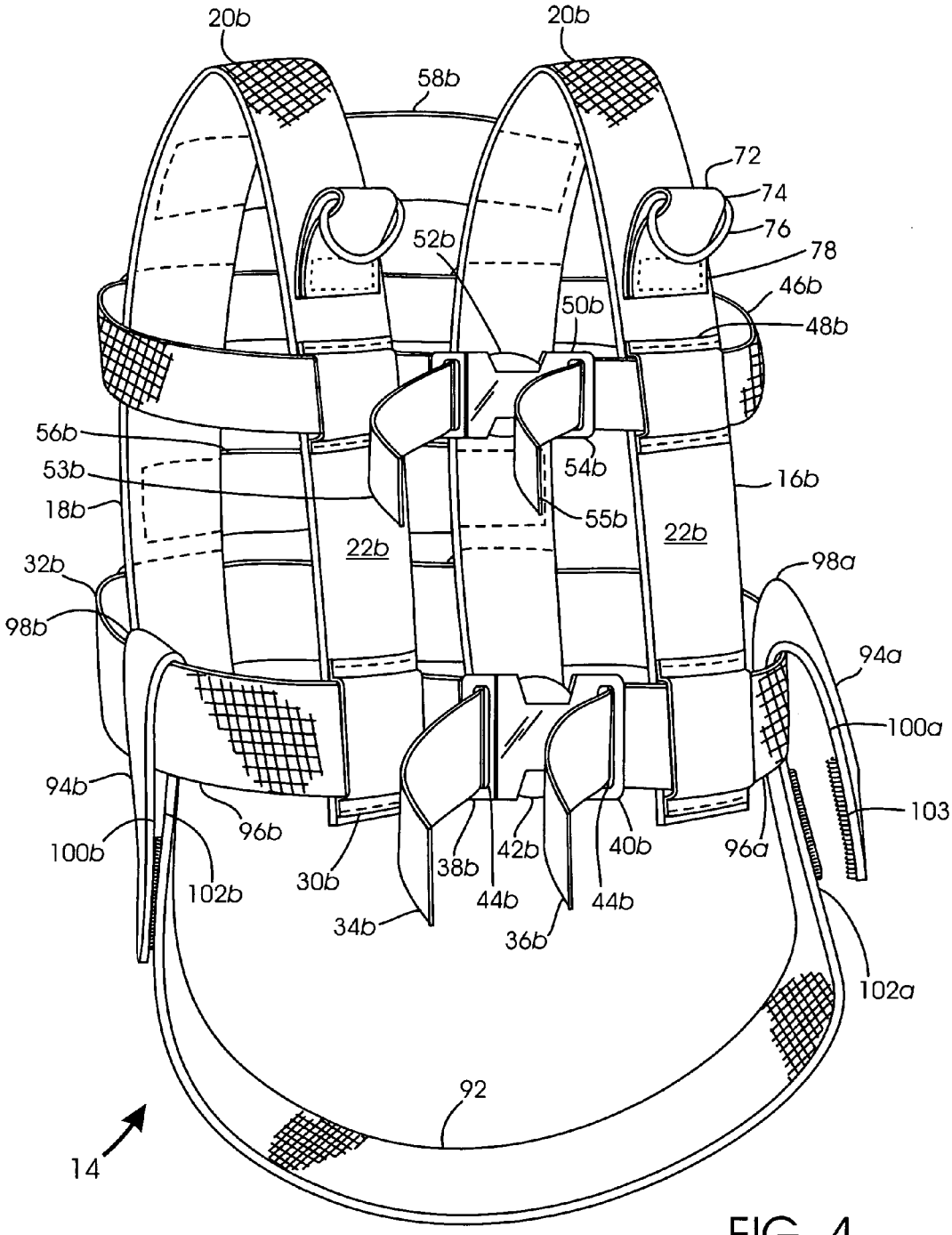
FIG. 4 is a front perspective view of the preferred embodiment of the present invention illustrating a recipient harness having a leg strap fitted to a portion of a waist belt.
Figure 5:
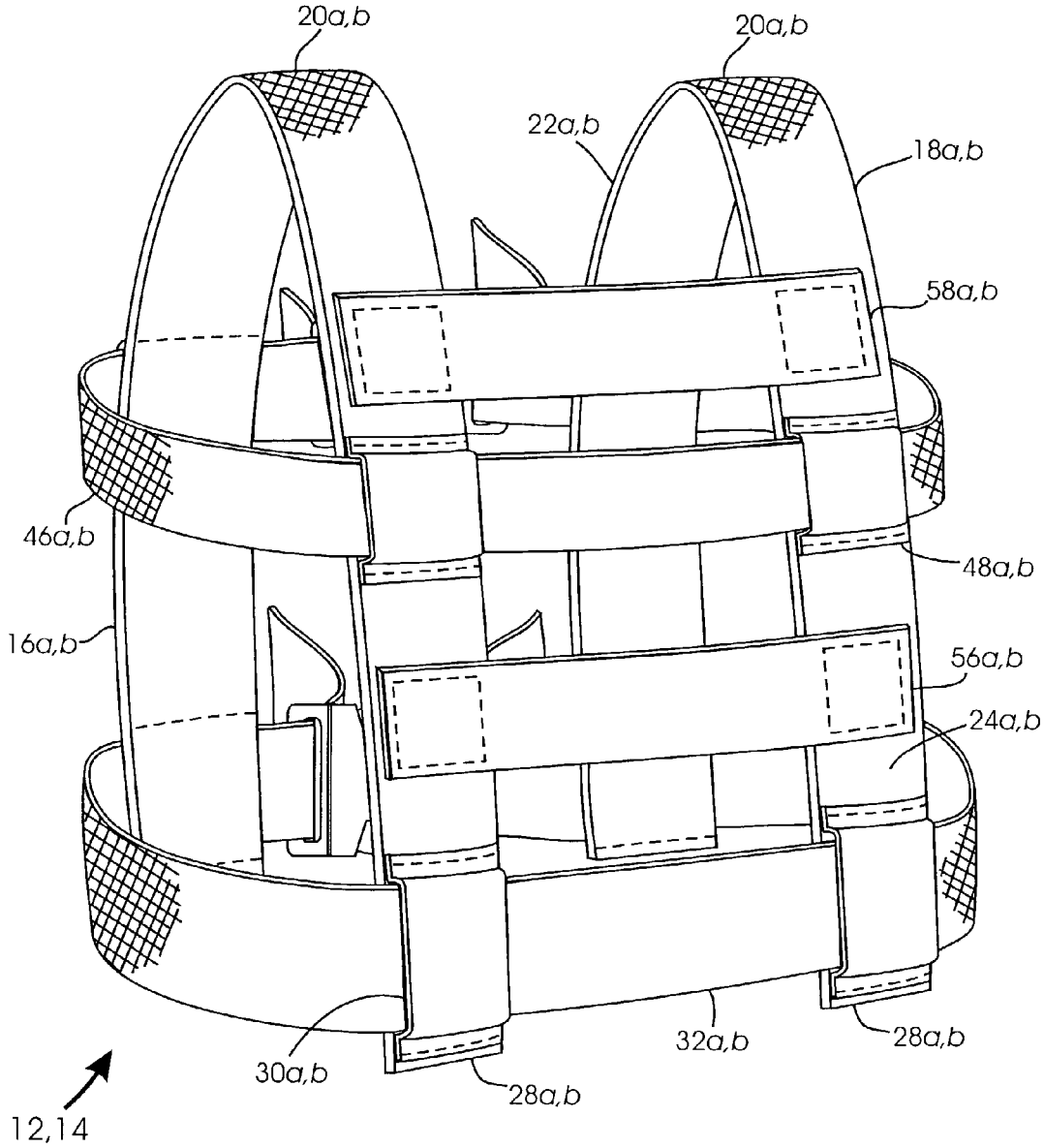
FIG. 5 is a back perspective view of the preferred embodiment of the present invention illustrating either a support or recipient harness having a pair of horizontal support members attached thereto.
Figure 6:
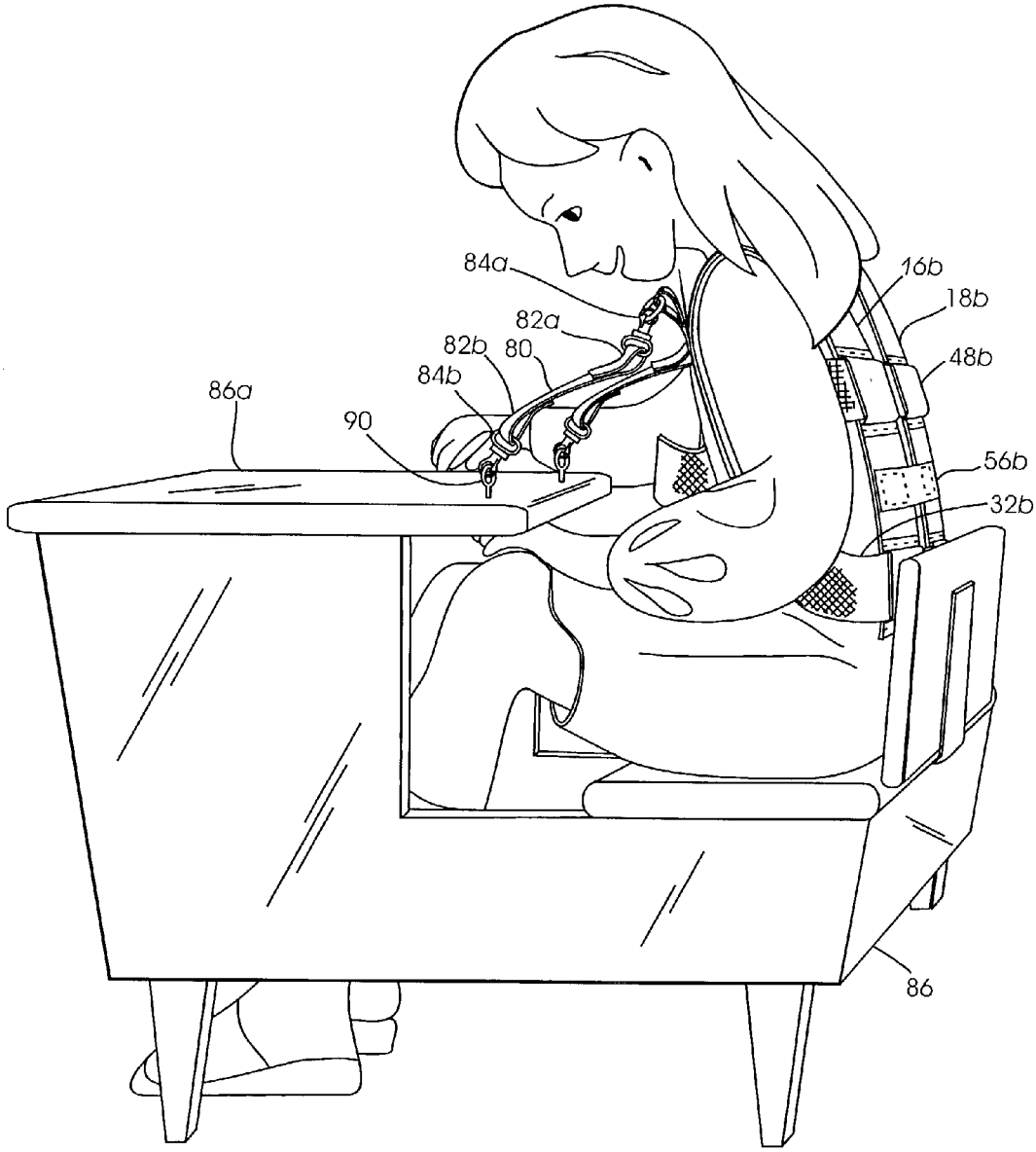
Figure 7:
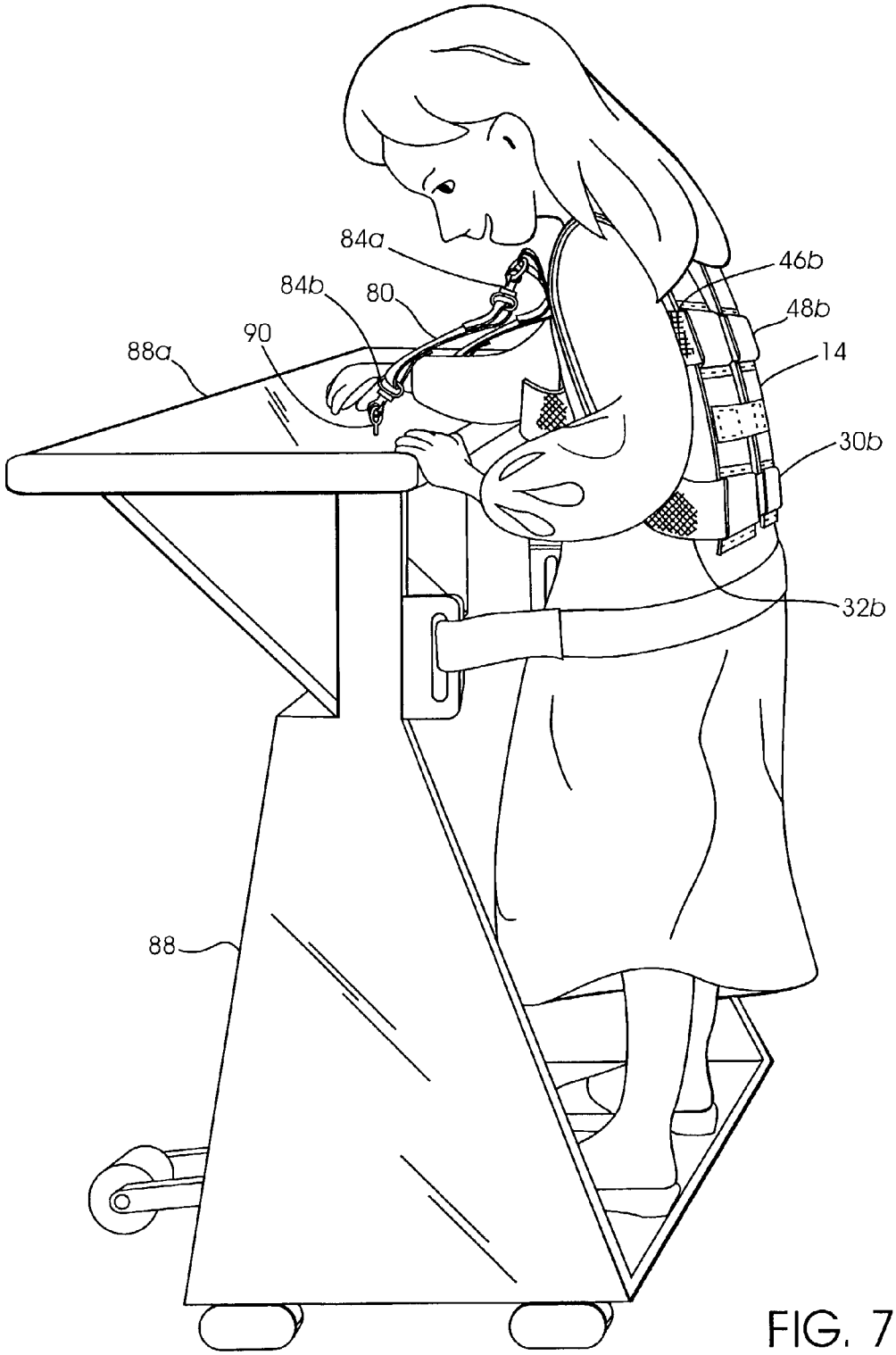

As depicted in FIG. 1, the support and recipient harnesses 12, 14 each preferably comprise left- and right-handed shoulder straps 16*a*, 16*b*, 18*a*, 18*b* configurably arranged in a parallel relation with one another, with each shoulder strap being fabricated from a continuous piece of material. In the preferred embodiment, each shoulder strap of continuous construction further comprises an apex 20*a*, 20*b* and proximal and distal sides 22*a*, 22*b*, 24*a*, 24*b*, with each side having first and second ends 26*a*, 26*b*, 28*a*, 28*b* being substantially positioned across from one another. In instances of wearing either the support harness 12 or recipient harness 14, the apex 20*a*, 20*b* will generally be configurably established atop the wearer's shoulder causing the first and second ends 26*a*, 26*b*, 28*a*, 28*b* of the left- and right-handed shoulder straps 16*a*, 16*b*, 18*a*, 18*b* to be disposed at and near the wearer's waistline. In order to permit this configuration and maintain an adequate level of comfort to the wearer, particularly during the strenuous activity of lifting or being lifted from an at-rest position, the shoulder straps are made from a pliable, woven material. Pliable, woven materials of choice must be capable of conforming to the contours of differing body types and resisting tensile deformation during sustained and repeated use. Moreover, the pliable, woven material should possess significant strength to support loads of at least 200 pounds without significant stretching to cause permanent deformation or breakage. Suitable types of materials considered most appropriate for this application may consist of woven Nylon®, tightly woven cotton, and a carbon/cotton composite, to name a few of the types readily available and commonly known in the art. Since in some instances the harnesses 12, 14 may be suitably worn over extended periods of time, it is preferable that the chosen material possesses decorative characteristics to the extent of an article of clothing and yet maintains a level of functionality. Located near and above the first and second ends of each of the left- and right-handed straps is a plurality of strap guides 30*a*, 30*b* which receive and permit passage of a waist belt 32*a*, 32*b*. The strap guides and waist belt collectively serve as means to secure the right- and left-handed shoulder straps 16*a*, 16*b*, 18*a*, 18*b* tightly to the wearer's waistline insofar to inhibit unwanted twisting or lateral movement of the shoulder straps as the wearer engages in the strenuous activity of lifting the disabled person or patient from an at-rest position. Each strap guide 30*a*, 30*b*, as shown in FIG. 1, is preferably positioned onto each of the shoulder straps' outer surface and cross stitched thereon with thread. Though not expressly shown herein, other prior art means of securing the strap guides to the shoulder straps are equally noted herein, such as selectively arranged rivets. The waist belt 32*a*, 32*b*, which comprises first and second ends 34*a*, 34*b*, 36*a*, 36*b*, is tighteningly held in place about the wearer's waistline by a waist buckle 38*a*, 38*b* comprising female and male connectors 40*a*, 40*b*, 42*a*, 42*b* with each connector having an elongate vertical slot 44*a*, 44*b* for receiving and slidably positioning the waist belt ends therethrough. Although not shown herein, each harness 12, 14 in lieu of the waist buckle may comprise a waist belt having ends affixed with VELCRO® to provide ready means to fit and secure the support harness on the wearer. Given the presence of tensile forces acting on the shoulder straps, specifically near the upper regions thereof during the activity of lifting, the support harness as well as the recipient harness further comprise an upper torso strap 46*a*, 46*b* which is configurably arranged in parallel relation to the waist belt 32*a*, 32*b* and is fitted about and around the upper torso region of the wearer, near and below the junction of the arm and shoulder, as illustrated in FIG. 2. Similar to what was described for the waist belt in terms of securing it to either the support harness 12 or recipient harness 14, the upper torso strap is slidably fitted and guided through at a plurality of torso strap guides 48*a*, 48*b* fixedly attached to the left- and right-handed shoulder straps 16*a*, 16*b*, 18*a*, 18*b* by thread or equivalent means. Preferably, each torso strap guide is positioned downwardly from the apex 20*a*, 20*b* approximately one-third the length of either the proximal or distal sides, as depicted in FIGS. 3 and 4. A torso buckle 50*a*, 50*b* comprising equivalent connecting means described for the waist buckle, namely male and female connectors 52*a*, 52*b*, 54*a*, 54*b*, slidably attached to a pair of ends 53*a*, 53*b*, 55*a*, 55*b* of the upper torso strap, tighteningly secures the upper torso strap about and around the wearer's upper torso. As means of maintaining a fixed parallel relation and separation of the right- and left-handed shoulder straps on the wearer, the support and recipient harnesses 12, 14 each comprise at least one horizontal support member 56*a*, 56*b* fixedly attached to the distal sides of the left- and right-handed shoulder straps. As shown in FIG. 5, the horizontal support member is preferably crossed stitched to the shoulder straps using thread and is generally arranged in parallel relation with and situated at midpoint between the upper torso strap and waist belt. In some instances where the support harness or recipient harness is sized to fit a larger person, a second horizontal support member 58*a*, 58*b* may be employed to mitigate the occurrence of slippage from the wearer's shoulder as the wearer proceeds in certain activities of lifting or being lifted from an at-rest position. Likewise, the second horizontal support member is preferably attached to the distal sides of the left- and right-handed shoulder straps, but is substantially disposed above the first horizontal support member, specifically at midpoint between the upper torso strap and shoulder straps' apexes 20*a*, 20*b*.

Referring now to FIG. 1, the support harness is distinguishable from the recipient harness insofar that the support harness 12 comprises first and second supporting tethers 60*a*, 60*b* emanating therefrom a predetermined distance. The supporting tethers primarily serve as means to readily connect the support harness to the recipient harness 14 for purposes of engaging in patient-assisting activities, namely lifting and supporting, and, in some cases, suspending the patient above the ground for a short duration for re-positioning the patient or administrating bedside treatment. In order to gain a moderate level of leverage to ease the amount of strength needed to lift a disabled person from an at-rest position, each supporting tether 60*a*, 60*b* is preferably mounted to the proximal side 22*a* of each of the left- and right-handed support straps 16*a*, 18*a*, near and above the upper torso strap 46*a*, by thread or equivalent means commonly known in the art. Fixedly attached to the opposite end of each of the supporting tethers 60*a*, 60*b* is a quick-release fastener 62 comprising a hook member 64 and a handle 68 adaptably configured to slide open and close to accept and lock onto a portion of a mounting strap 72 made part of the recipient harness, respectively.

As depicted in FIG. 4, the recipient harness 14 preferably comprises a pair of mounting straps 72 each having one end 74 fixedly connected to a support ring 76 and a second end 78 fixedly connected to the proximal side of the shoulder strap of the recipient harness 14, near and above the torso strap guides 48*b*, substantially in the same location where the supporting tether 60*a*, 60*b* is attached to the support harness 12. This mounting configuration affords the assisting person or health care worker to be strategically positioned face-to-face with the disabled person to achieve maximum coordination of movement for less strenuous effort during the activity of lifting. In the preferred embodiment, each mounting strap 72 comprises a length shorter than that of the supporting tether 60*a*, 60*b* generally comprising an effective length of approximately 3" so as to mitigate the occurrence of undue interference while the recipient harness 14 is being continuously worn.

In an alternative embodiment, as shown in FIGS. 2 and 3, the supporting harness 12 may comprise shorter supporting tethers, substantially equivalent to the length of the mounting strap used for the recipient harness, in order to accommodate the same purpose as stated hereinbefore for the recipient harness 14, namely to be worn for a continuous period of time without undue interference. In such instance, first and second flexible extensions 80*a*, 80*b* of the type shown in FIG. 2 may be used to temporarily extend the length of the supporting tethers 60*a*, 60*b* of shorter length to connect the support harness to the recipient harness for purposes of engaging in the activity of lifting and/or supporting the disabled person, as hereinbefore described. Each flexible extension preferably comprises two ends 82*a*, 82*b*, with each end being equipped with a quick-release fastener 84*a*, 84*b* of the type described for use with the supporting tethers 60*a*, 60*b*.

Although in most instances the harness assembly effectively serves its intended purpose to lift and support a disabled person without the addition of other features, more so than those discussed hereinbefore, it may be desirable to equip the recipient harness with a leg strap 92 should it become necessary to lift a person having no muscular ability whatsoever to stand erect or walk. As shown in FIG. 4, the leg strap preferably comprises first and second ends 94*a*, 94*b* each of which encircle and engage a portion 96*a*, 96*b* of the waist belt 32*b*. Each end of the leg strap 92 preferably comprises a crease 98*a*, 98*b* defining first and second inner surfaces 100*a*, 100*b*, 102*a*, 102*b* adaptably affixed with a hook and loop fastener 103 known in the art as VELCRO® or with an equivalent securing means. In use of the leg strap, the first end 94*a* of the leg strap is initially positioned perpendicular to and fastened to the waist belt 32*b* by positioning the crease 98*a* at the waist belt and folding thereat until the first and second inner surfaces 100*a*, 102*a* make contact and securely mate with one another. Once in this arrangement, the free end or second end 94*b* of the leg strap is slidably positioned below the disabled person's thighs, optimally being located at midpoint between the waist and knees, and pulled upwardly until the second end is positioned near the waist belt 32*b* for fastening thereat, typically in the same manner as the first end of the leg strap 92. In most instances of correct usage, the recipient harness 14 fitted with the optional leg strap 92 will effectively cause the disabled person to become configurably cradled insofar to establish a balanced load for greater ease in handling the disabled person on a momentary basis.

It can be seen from the foregoing that there is provided in accordance with this invention a simple and easily operated device, which is particularly suitable for lifting and supporting a person having little or no control over muscular function to enable oneself to engage in the activity of either standing erect or walking. The multipurpose harness assembly 10 is completely functional in a variety of hospice and educational settings to readily lift and move a disabled person for purposes of administrating bedside treatment and/or preparing the disabled person for transport therewithin or to classrooms in an educational institution. Unlike other harnesses of the type known in the art, the present invention can be loosely fitted about the wearer for added comfort, particularly during continuous and sustained periods of use, and yet maintains complete functionally. It is obvious that the components comprising the multipurpose harness assembly may be fabricated from a variety of materials, providing such selection or use of materials possess the capacity to withstand tensile forces acting thereon throughout its duration of use in a hospice setting. Accordingly, it is most desirable, and therefore preferred, to construct the multi-purpose harness assembly 10 from a flexible, yet pliable material which affords the most comfort to the wearer for long-term, continuous wear and ensures a level of sustained reliability during use thereof, as hereinbefore stated.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A method for assisting a muscular-incapacitated person, said method comprising the steps of:

fitting support and recipient harnesses onto an assisting person and a muscular-incapacitated person, respectively, each of said harnesses having left- and right-handed shoulder straps each of which comprise first and second ends;

attaching to said left- and right-handed shoulder straps of each harness a horizontal support member to hold together and maintain a parallel relation of said left- and right-handed shoulder straps as said harness is being worn;

equipping each harness with a waist belt which is slidably positioned through a plurality of support guides fixedly connected to distal and proximal sides of said left- and right-handed shoulder straps of said harness, said waist belt having first and second ends fitted through a waist buckle for tighteningly holding said first and second ends of said left- and right-handed shoulder straps of said harness near and about a wearer's waistline; and connecting together said support and recipient harnesses in a frontal arrangement with one another to achieve maximum coordination of movement for less strenuous effort during the activity of lifting using first and second supporting tethers, said first supporting tether having one end affixed to the proximal side of said left-handed shoulder strap of said support harness and a second end equipped with a quick-release fastener for engaging a support ring mounted onto a second end of a first mounting strap extending outwardly from the proximal side of said right-handed shoulder strap of said recipient harness, said second supporting tether having one end affixed to the proximal side of said right-handed shoulder strap of said support harness and a second end equipped with a quick-release fastener for engaging a support ring mounted onto a second end of a second mounting strap extending outwardly from the proximal side of said left-handed shoulder strap of said recipient harness, said first and second mounting straps each comprise first ends fixedly attached to the proximal side of said right- and left-handed shoulder straps of said recipient harness, respectively.

2. A method as set forth in claim 1, further comprising the step of equipping said recipient harness with a leg strap having first and second ends each having first and second inner surfaces defined by a crease and affixed with a hook and loop fastener, said first and second ends each being adaptably configured to engage a portion of said waist belt and lock thereon as said first and inner surfaces of said first and second ends are inwardly positioned to mate with one another.

3. A method as set forth in claim 1, further comprising the step of equipping each harness with an upper torso strap which is slidably positioned through a plurality of torso strap guides fixedly attached to said left- and right-handed shoulder straps of said harness and configurably arranging said upper torso strap above and in parallel relation to said waist belt to be tighteningly held in place by a torso buckle.

4. A method as set forth in claim 1, said quick-release fastener comprising a hook member having a handle attached thereto to slidably open and close said hook member insofar to engage said support ring therewith.

* * * * *